US010639762B2

(12) United States Patent
Lee

(10) Patent No.: US 10,639,762 B2
(45) Date of Patent: May 5, 2020

(54) ARM FOR BLADE SHARPENING DEVICE

(71) Applicant: Alexander Wing Lee, Portland, OR (US)

(72) Inventor: Alexander Wing Lee, Portland, OR (US)

( * ) Notice: Subject to any disclaimer, the term of this patent is extended or adjusted under 35 U.S.C. 154(b) by 97 days.

(21) Appl. No.: 15/803,593

(22) Filed: Nov. 3, 2017

(65) Prior Publication Data

US 2018/0126513 A1 May 10, 2018

Related U.S. Application Data

(60) Provisional application No. 62/420,252, filed on Nov. 10, 2016.

(51) Int. Cl.

| | |
|---|---|
| ***B24B 3/52*** | (2006.01) |
| ***B24B 3/54*** | (2006.01) |
| ***B24B 41/06*** | (2012.01) |

(52) U.S. Cl.

CPC ..... *B24B 3/52* (2013.01); *B24B 3/54* (2013.01); *B24B 41/06* (2013.01); *B24B 41/066* (2013.01)

(58) Field of Classification Search

CPC .... B24B 1/06; B24B 1/66; B24B 3/52; B24B 3/54

See application file for complete search history.

(56) References Cited

U.S. PATENT DOCUMENTS

| | | | | |
|---|---|---|---|---|
| 1,019,887 A * | 3/1912 | Fowler | B24B 41/066 | 451/367 |
| 1,178,002 A * | 4/1916 | Ekman | B24B 41/066 | 451/369 |
| 4,528,778 A * | 7/1985 | Wolff | B24B 41/066 | 451/224 |
| 5,941,763 A * | 8/1999 | Kaye | B24B 3/36 | 269/262 |
| 7,465,220 B1 * | 12/2008 | Wolff | B24B 3/52 | 451/178 |
| 7,959,494 B1 * | 6/2011 | Pietrzak | B24B 3/52 | 451/293 |

FOREIGN PATENT DOCUMENTS

JP 09174397 A * 7/1997

* cited by examiner

*Primary Examiner* — Daniel J Colilla
(74) *Attorney, Agent, or Firm* — Mark S. Hubert

(57) ABSTRACT

An arm for a blade sharpening device, intended to be retrofitted onto an existing, conventional blade sharpening device so as to offer an inexpensive option to upgrade the operational simplicity and operability of the device. It has a three hingeable link linear support arm that has a lock collar affixed an its proximal end. The lock collar slidingly retains a blade clamp barrel with a blade clamp affixed at its proximal end. The lock collar allows the retraction, extension and limits the rotation of the blade.

7 Claims, 7 Drawing Sheets

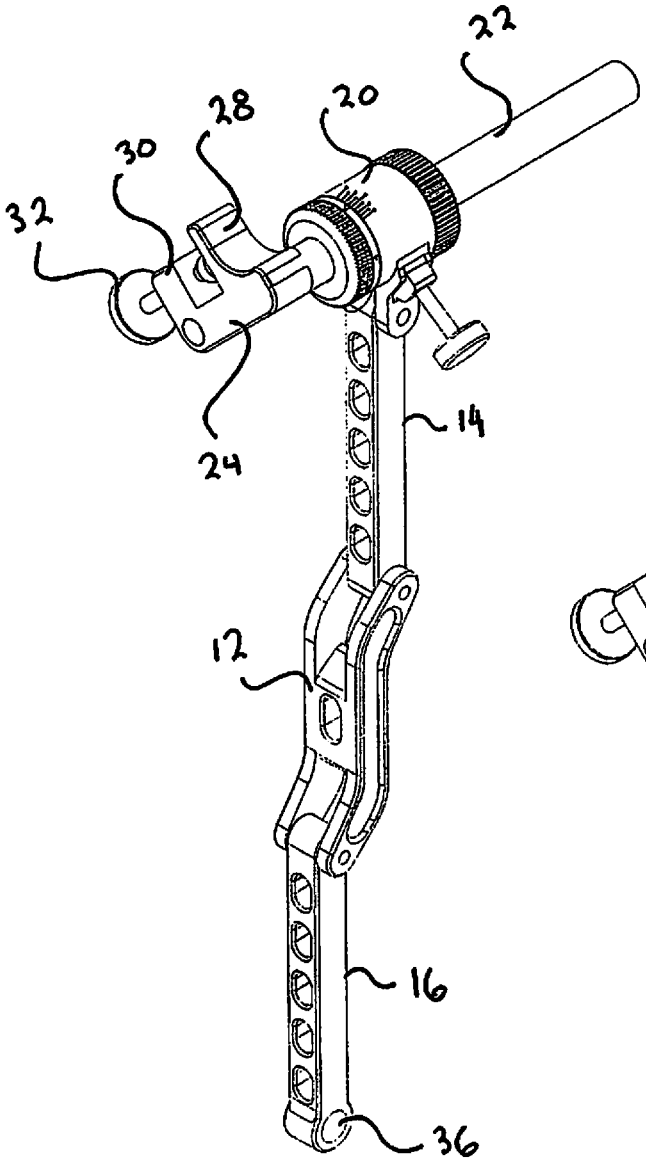
FIG 3
FIG 4
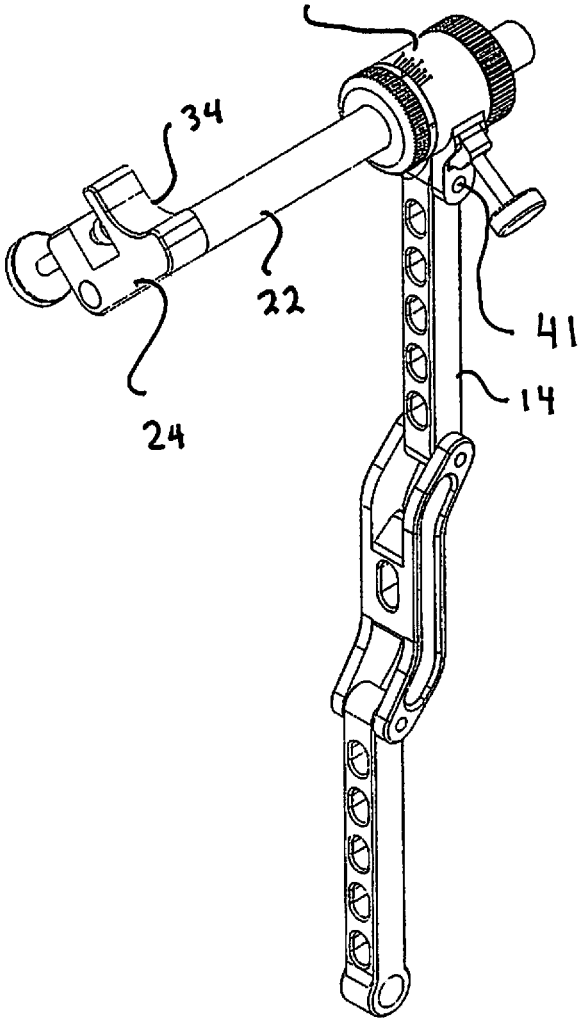

ARM FOR BLADE SHARPENING DEVICE

PRIORITY

This utility patent application incorporates by reference, and is a continuation in part of utility application Ser. No. 62/420,252 entitled "Improved Arm for Blade Sharpening Device" and filed on Nov. 10, 2016.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to blade sharpening devices, and more particularly to a retrofit arm for use on a scissor or knife blade sharpening grinder.

BACKGROUND

When sharpening the blades of knives, scissors or other working tools, the precise angle the edge to be sharpened contacts the grinding/honing surface determines the sharpness of the edge that the tool will have. Generally, the blade sharpening grinders are heavy stationary units that have at least one spinning, abrasive grinding wheel that the blade may be passed across to garner an edge. This is generally done by hand, but still requires an accurate and adjustable support with minimal deviation in holding the tool at the proper angular orientation while the blade contacts the grinding wheel.

The prior art devices are segmented linear arms that are slidingly attached at their distal end to a rail extending from the grinder that lies approximately parallel to the planar face of the grinding disks. There is an angularly adjustable and pivotable clamp affixed at one of its ends to the proximal end of the linear arm. The linear arm is hinged in its approximate center. Such as design is detailed in US. Pat. No. 5,941,763. This design allows for the user to alter the vertical and angular positioning of any bladed tools as it slides horizontally along the rail. The problem with the prior art devices is that while they allow the proper positioning of the clamped blade, their path of movement and range of motion is compromised and very limited. This is hard for novices to use as the repeated vertical path of motion is difficult to repeat. Additionally, the physical structure of the prior art forces each user to hold the moving segmented linear arm in the same way, regardless of their dexterity capabilities.

Thus, a more vertically controllable linear arm able to be held in a plethora of different ways is provided by the embodiments set forth below.

BRIEF SUMMARY

In accordance with various embodiments, an improved blade sharpening arm for a blade sharpening device, is provided.

In one aspect, a vertically adjustable linear arm that can be retrofitted onto the horizontal rail of conventional blade sharpening devices, having increased vertical freedom of motion is provided. The repeated vertical placement movements of the linear arm by the operator are easier to repeat and accomplish both by the increased freedom of motion and by the adjustable location of the blade clamp barrel on the lock collar.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 3 is a side perspective view of the blade sharpening arm with the blade clamp barrel retracted;

FIG. 4 is a side perspective view of the blade sharpening arm with the blade clamp barrel extended;

DETAILED DESCRIPTION

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The present invention relates to a novel design for an arm for a blade sharpening device, intended to be retrofitted onto an existing, conventional blade sharpening device so as to offer an inexpensive option to upgrade the operational simplicity and operability of the device.

Figure 1:
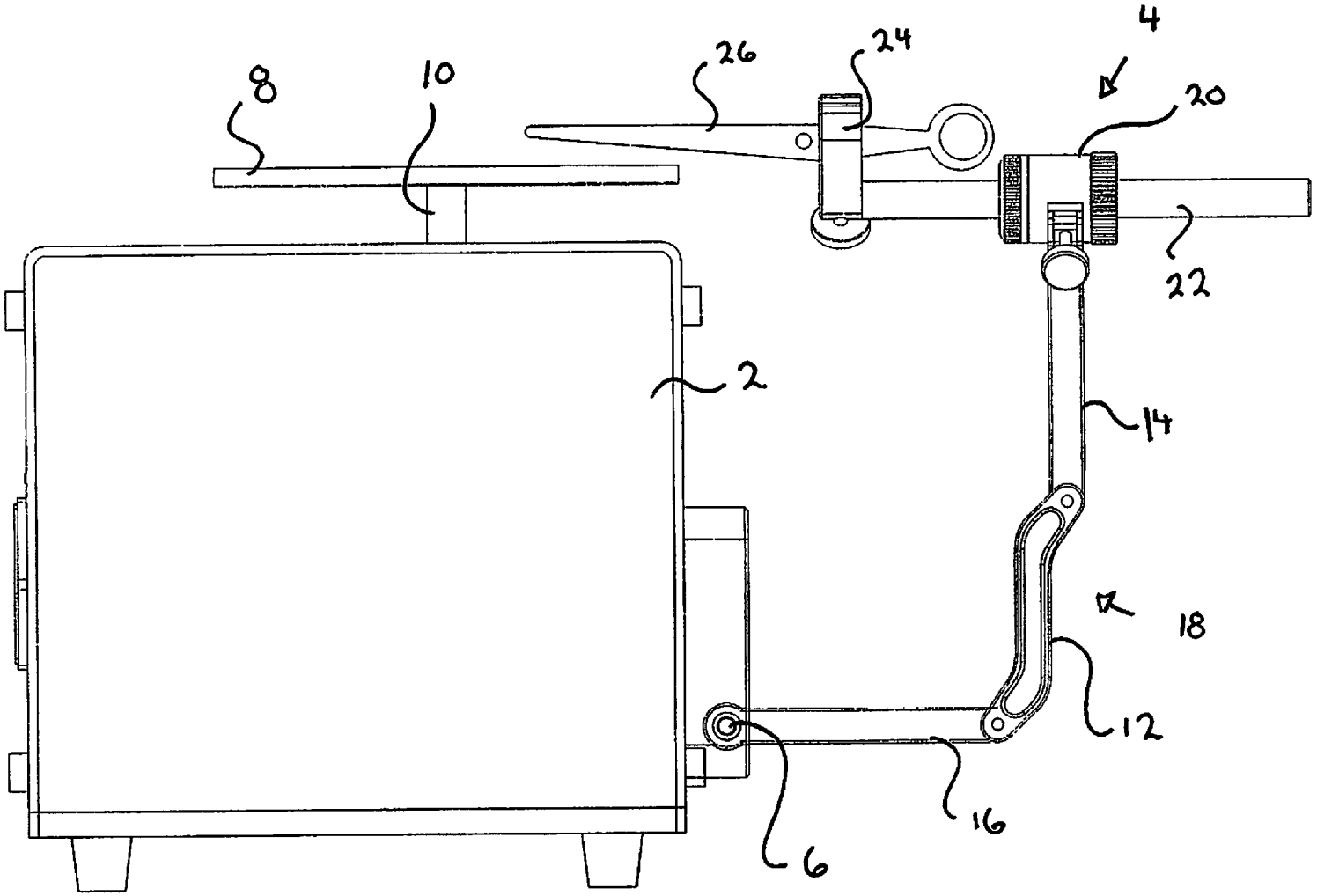
FIG. 1 is a side view of the blade sharpening arm slidingly attached to a conventional blade sharpening device.
Figure 2:
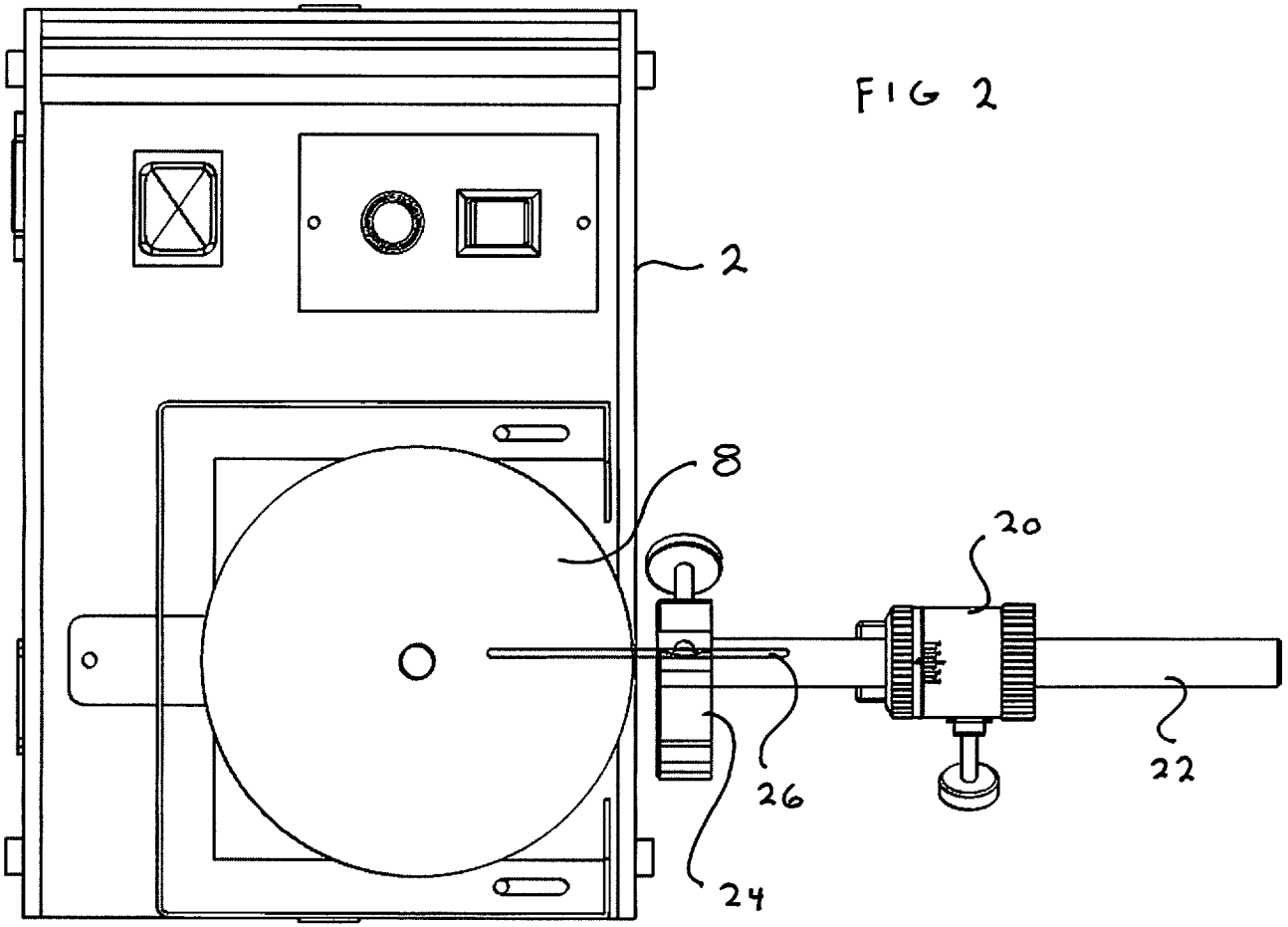
FIG. 2 is a top view of the blade sharpening arm slidingly attached to a conventional blade sharpening device.

Looking at FIGS. 1 and 2, a blade sharpening device with the blade sharpening arm 4 slidingly affixed to the horizontal front rail 6 can best be seen. Here a conventional blade sharpening device 2 is a housing with an internal electrical motor that rotates at a high speed, a horizontal, grinding/honing abrasive disk 8 that is connected to a shaft 10 that extends from the motor through the housing. The blade sharpening arm 4 has at least three rigid mechanical link members (an upper link member 14, a middle link member 12 and a lower link member 16) that are hingedly connected at their distal and proximal ends so as to form a linear support arm 18 that is flexible in the vertical plane only.

At the proximal end of the upper link member 14 is a pivotal connection to a rotatable lock collar 20. A pivot arm 70 with a central through bore, extends from the lock collar 20 and is pivotally connected to an orifice through the proximal end of the upper link member 14 by a circular cylindrical pin 62. Through the center circular orifice in the lock collar 20, is a blade clamp barrel 22 adapted for sliding and rotational engagement within the lock collar 20. At the proximal end of the blade clamp barrel 22 is a blade clamp 24. In theory, a blade to be sharpened (such as the scissors 26) is compressively clamped in the blade clamp 24, the length the blade clamp barrel 22 extends from the lock collar 20 is adjusted by moving it forward or backward in the lock collar 20, the blade clamp barrel 22 is locked at its position in the lock collar 20, then the rotation angle for the blade clamp barrel 22 (and the blade clamp 24) is set on the lock collar 20 so the proper vertical angle of the blade is presented for contact with the spinning abrasive face of the disk. The blade clamp barrel 22 (and blade clamp 24) may be hand rotated slightly while being raised, to alter the profile of the blade edge according to the blade's application.

Looking at FIG. 3 it can be seen that the blade clamp barrel 22 is retracted into the lock collar 20 while FIG. 4 shows the blade clamp barrel 22 extended from the lock collar 20. It is to be noticed that the blade clamp 24 has a socket to accept the proximal end of the blade clamp barrel 22. The blade clamp 24 is affixed to the blade clamp barrel 22 by a suitable means of pinning, preferably by a set screw that partially extends down from the blade clamp 24 and imbeds into a matingly conforming recess in the proximal end of the blade clamp barrel 24. (Not visible in FIGS. 5 and 6.) Other mechanical means such as gluing, brazing or pinning with a split roll pin or the equivalent is well known in the art and may be substituted.

The blade clamp 24 has a pair of generally parallel first and second brackets 30 and 28 held in a parallel U shaped configuration by a bottom spacer 77 so as to have opposing planar faces. Extending through a threaded orifice in the first bracket 30 is a threaded thumbscrew 32 that may be threadingly advanced toward the second bracket 28 so as to compressively and frictionally constrain the blade of the tool to be sharpened. On the backside of the second bracket 28 is a C shaped thumb rest contour 34 for the application of force toward the direction of movement of the article to be sharpened (FIGS. 3-6).

The three rigid mechanical link members (an upper link member 14, and middle link member 12 and a lower link member 16) are pinned at their ends to each other so as to form a linear flexible chain. The distal end of the lower link member 16 has a through circular bore 36 that mounts onto the cylindrical horizontal front rail 6 so as to allow horizontal sliding movement of the blade sharpening arm 4 along this front rail 6. The three link design allows for vertical movement of the blade sharpening arm simultaneous with horizontal movement of the blade sharpening arm along and parallel with the horizontal front rail. It is this three link design that allows much more precise and easily repeatable positioning of the blade in relation to the spinning abrasive disk. Although depicted with the middle ink member 12 having an "S" configuration, a straight configuration as shown on the upper and lower link members 14 and 16 is an acceptable alternate embodiment.

Figure 5:
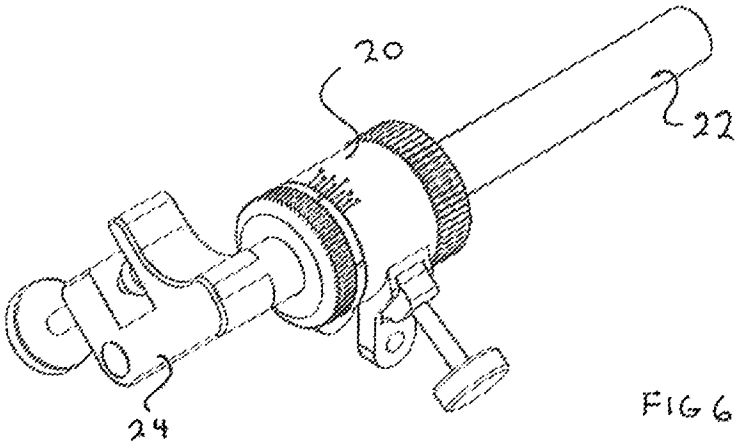
FIG. 5 is a is a side perspective view of the clamp and blade clamp barrel retracted in the lock collar.
Figure 6:
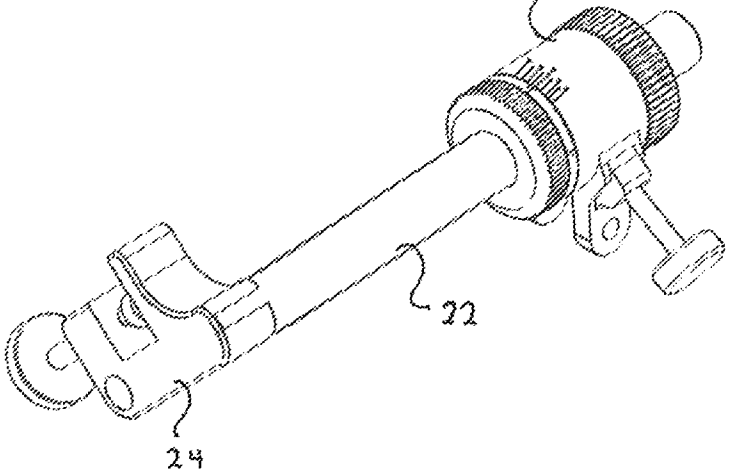
FIG. 6 is a is a side perspective view of the clamp and blade clamp barrel extended in the lock collar.

Looking at FIGS. 5 and 6, it can be seen that there are a pair of hinge arms 40 extending normally from the lock collar 20. These hinge arms 40 have through bores to accommodate the passing of a pin 41 through a second through bore formed in the proximal end of the upper link member 14 so as to impart pivoting motion capability to the lock collar 20 relative to the link members.

Figure 7:
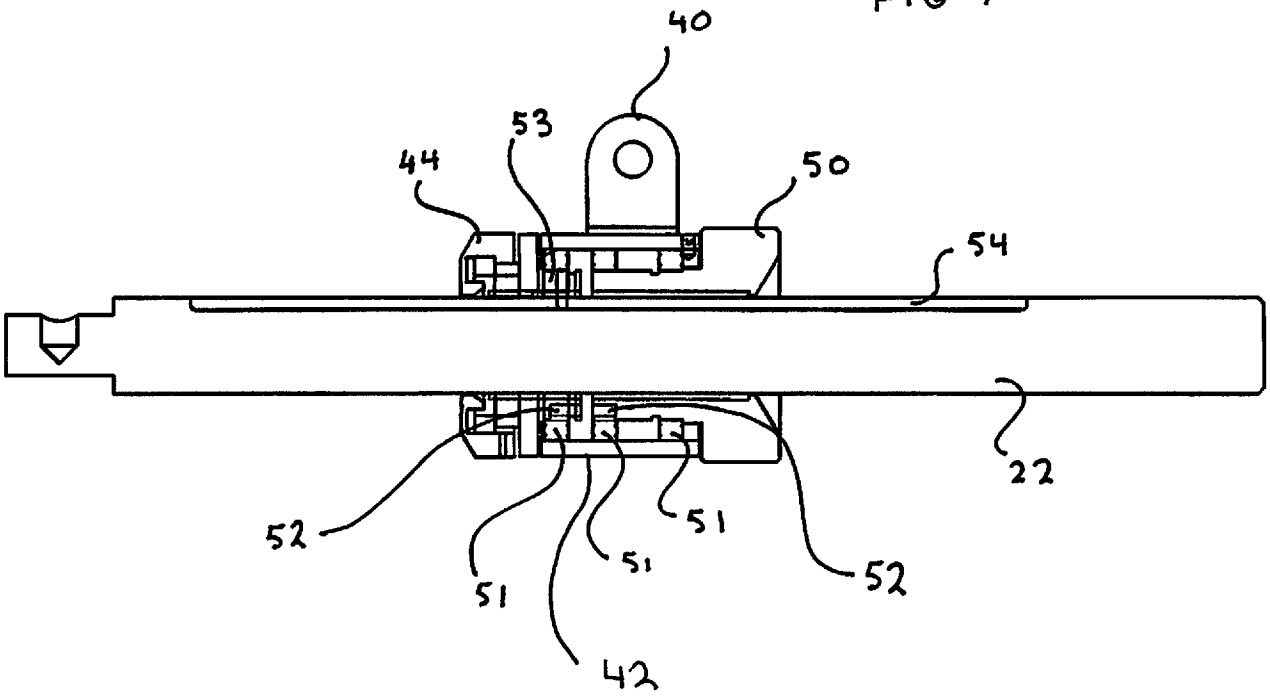
FIG. 7 is a cross sectional view of the lock collar and clamp rod.
Figure 8:
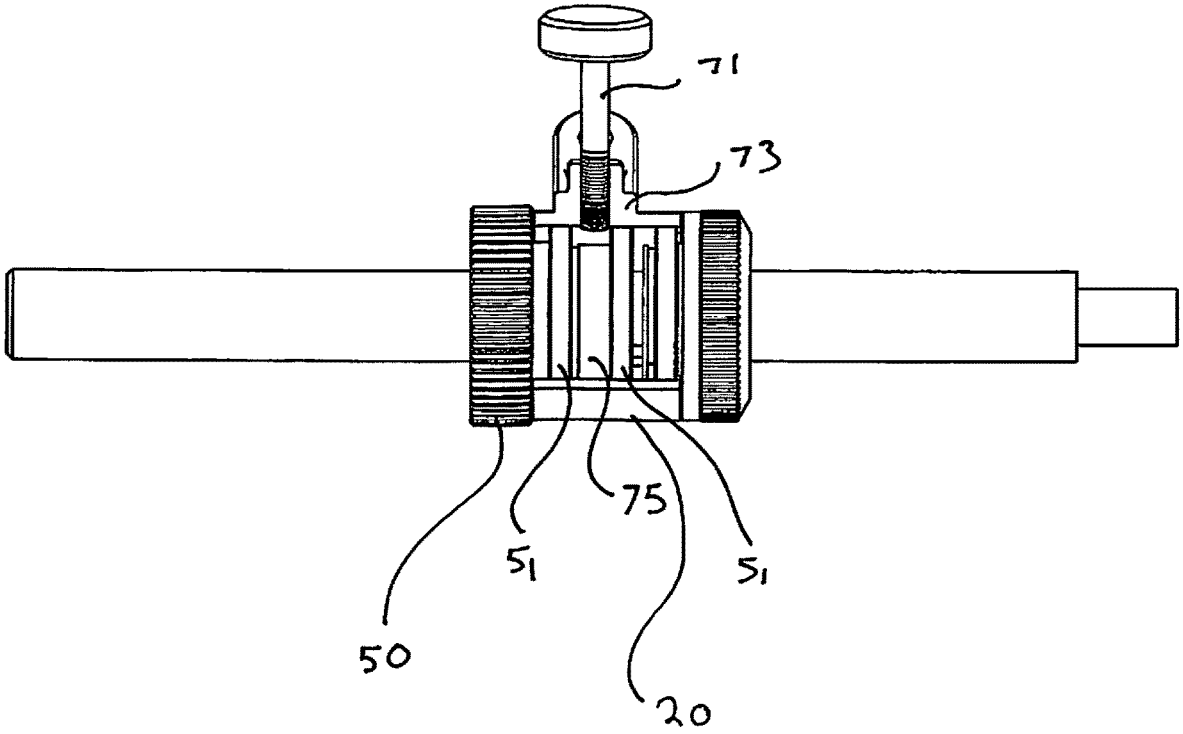
FIG. 8 is a cross sectional view of the lock collar and clamp rod rotated 90 degrees from FIG. 7.
Figure 9:
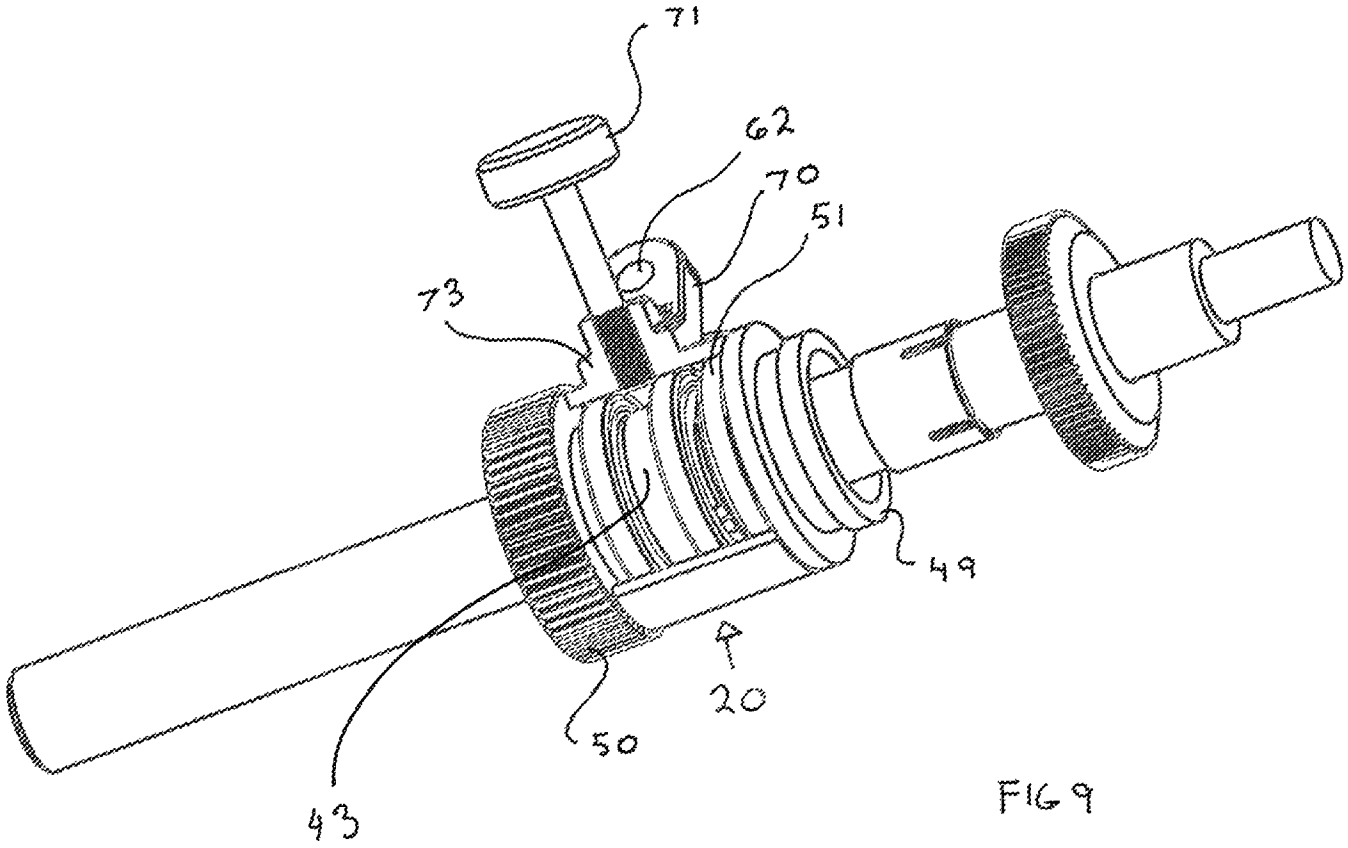
FIG. 9 is a perspective disassembled view with partial cutouts of the lock collar and clamp rod.

Looking at FIGS. 7-9, it can be seen that the lock collar 20 has a cylindrical central barrel section 42 and an inner cylinder 43 to which the blade clamp barrel 22 is slidingly affixed by a lock pin 52 extending from the inner cylinder 43 into a linear groove 54 cut partially along the length of the blade clamp barrel 22 so as to allow the blade clamp barrel 22 to side within the lock collar 20 (extending or retracting) to change the amount that the blade clamp 24 protrudes from the lock collar 20. The central barrel section 42 has a pair of plain bearings 51 extending inward to contact the outer surface of the rotation stop 50 which contacts the blade clamp barrel 22 so as to stabilize the entire lock collar 20 on the blade clamp barrel 22.

The central barrel section 42 and the inner cylinder 43 with its attached blade clamp barrel 22 may be rotated relative to each other. Between the front end of the inner cylinder 43 and the outside of the blade clamp barrel 22 is a radially slotted, circular cylindrical polymer jaw insert 45. There is an external thread 49 formed on the outside of the front end of the inner cylinder that is matingly conformed to an internal thread formed on the upper lock ring 44. When the upper lock ring 44 is threadingly engaged to the front end of the inner cylinder 43 and tightened, it forces the jaw insert 45 to circumferentially close around the blade clamp barrel 22 and frictionally lock the length the blade clamp barrel 22 extends from the front of the lock collar 20. The upper lock ring 44, the inner cylinder 43 and the blade clamp barrel 22 are now all threadingly and frictionally connected and rotate as one unit. (At this point the length of the blade clamp barrel 22 is fixed in the lock collar 20 but is free to rotate approximately 350 degrees within the lock collar 20 until another physical interference between the inner cylinder 43 and the rotation stop 50 occurs as discussed below.)

The rotation stop 50 is rotationally affixed at the bottom end of the central barrel section 42. Part of its cylindrical body fits between the blade clamp barrel 22 and the plain bearings 51 of the central barrel section 42. It has a rotation lock pin 52 extending from its front end parallel with the linear axis of the blade clamp barrel 22. The rotation lock pin 52 extends into a circumferential groove 53 cut around the back face of the inner cylinder 43. The groove 53 does not encircle the entire inner cylinder so as to make a ring, but rather extends only approximately 340-350 degrees leaving a stop member remaining. When the rotation stop 50 is rotated it has only 350 degrees of freedom in its rotation before its lock pin 52 abuts either of the ends of the groove in the inner cylinder 43. (The ends of the groove are so close together that they only span about 10 radial degrees of the inner cylinder the stop member so as to resemble a pin extending from the inner cylinder.) Conversely, when the rotation stop ring 50 is locked to the central barrel section 42 by frictional contact with the rotational lock thumbscrew 71 the inner cylinder 43 and the blade clamp barrel 22 may only be rotated until the ends of the groove 53 (the stop member) abut the lock pin 52.

The rotational lock thumbscrew 71 threadingly engages a matingly conformed boss 73 formed on the outer face of the central barrel section 42, such that it can be threaded inward to contact the face of a landing groove 75 cut in the rotation stop 50 located between the two plain bearings 51 in the central barrel section 42. This locks the rotation stop 50 to the central barrel section 42. (Note, this does not limit the 340-350 degrees of freedom the blade clamp barrel 22 has of rotation, but it changes (or indexes) the start and stop angular positions that the blade clamp barrel 22 have (and the connected blade in the blade clamp).

The central barrel section 42 is marked with a rotational scale 46 on its outer surface and the inner cylinder 43 has an index mark 48 on its outer surface that aligns with the various marking on the rotational scale 46. This rotational scale arrangement is used to set and establish the rotational extents of the blade clamp barrel 22 within the lock collar 20. To do this, the index mark 48 is aligned with the appropriate marking in the rotational scale 46 and the rotation stop 50 is rotated clockwise or counter-clockwise until its pin 52 abuts the op member (ends of the groove in the inner cylinder 43). The rotational lock thumbscrew 71 is tightened. This is the stop or maximum extent position (left or right) that the blade clamp barrel 22 can be rotated to. This is the returning position that the scissors can be brought back to each time they are drawn across the grinding wheel, prior to each of its sharpening strokes.

It is to be noted that there is an alternate embodiment for the design of the rotational extents of the blade clamp barrel 22 wherein there is a circular void around the body of the rotation stop 50 into which extends a stop pin residing perpendicular to the lock pin 52 extending from the rotational stop 50. This pin is another form of stop member. These pins compete for space and are in each other's paths and abut when the rotation stop 50 or the inner cylinder 43 is rotated. This allows the extents of the rotation of the blade clamp barrel 22 to be limited in either direction by the lock thumbscrew 71 as discussed herein.

To sharpen a blade, one need only affix the blade in the blade clamp 24; adjust the amount of the blade clamp barrel 22 that the user wants to extend from the lock barrel 22; manipulate the three link members to bring the blade to the top face of the grinding disk placing it in the angled configuration desired for sharpening; and set the rotation lock angle such that the blade clamp cannot be rotated beyond this angle. This serves as the stop for the repeated return to the same honing angle by the user. Now with the three link design the blade sharpening arm 4 can easily be brought to the proper vertical location and then traversed completely horizontally to the grinding wheel while horizontal travel and or adjustments are made in the perpendicular horizontal axis.

While certain features and aspects have been described with respect to exemplary embodiments, one skilled in the art will recognize that numerous modifications are possible. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. A blade sharpening arm for use on a scissor or knife blade sharpening grinder, comprising:

a rigid upper link member having a first upper end and a first lower end;

a rigid lower link member having a third upper end and a third lower end, said lower end having an axial bore there through for attachment to said grinder;

a rigid middle link member having a second upper end and a second lower end, said middle link member pivotally connected between said rigid upper link member and said rigid lower link member;

a rotatable lock collar with a central orifice, said lock collar hingedly attached to said first upper end of said upper link member;

a round cylindrical blade clamp barrel having a distal end and a proximal end, said blade clamp barrel slidingly mounted in said central orifice of said lock collar; and a blade clamp affixed to said proximal end of said blade clamp barrel; and wherein said lower link member mounts onto a cylindrical horizontal front rail of said blade sharpening grinder so as to allow horizontal sliding movement of said blade sharpening arm along said front rail.

2. The blade sharpening arm of claim 1 wherein said middle link member is S shaped and said upper link member and said lower link member are linear.

3. The blade sharpening arm of claim 2 wherein said blade clamp further comprises:

a U shaped body formed by a first bracket and a second bracket having opposing inner faces, said brackets held in a parallel configuration by a bottom spacer, where said first bracket has a threaded thumbscrew having a distal end that is threadingly advanceable from an inner face of said first bracket toward an inner face of said second bracket, and wherein an outer backside face of said second bracket has a C shaped thumb rest contour formed thereon.

4. The blade sharpening arm of claim 3 wherein said lock collar has a cylindrical central barrel section housing an inner cylinder, said inner cylinder has a lock pin extending inward that resides in a linear groove cut partially along the length of the blade clamp barrel so as to slidingly receive said blade clamp barrel in said lock collar; and wherein said central barrel section has at least one plain bearing extending inward to stabilize said lock collar on said blade clamp barrel.

5. The blade sharpening arm of claim 4 further comprising:

a radial slotted circular cylindrical polymer jaw insert that is positioned between said inner cylinder and said blade clamp barrel;

an upper lock ring threadingly engaged onto a front end of said inner cylinder such that tightening said upper lock ring onto said inner cylinder circumferentially closes said jaw insert onto said blade clamp barrel to lock said inner cylinder and said upper lock ring to said blade clamp barrel.

6. The blade sharpening arm of claim 5 further comprising:

a rotational stop, said rotational stop is rotationally affixed to a bottom end of said central barrel section and has a cylindrical body, part of said body residing between said plain bearings and said blade clamp barrel;

a lock pin extending from a front face of said rotational stop; and a stop member extending from said inner cylinder; and wherein said rotational stop may be rotated approximately 340-350 degrees in either direction until said lock pin abuts said stop member.

7. The blade sharpening arm of claim 6 further comprising:

a threaded boss formed on an outer face of said central barrel section;

a rotational lock thumbscrew matingly conformed for engagement with said boss; and wherein said rotational lock thumbscrew threadingly advances so as to contact said rotational stop, frictionally connecting said rotational stop to said central barrel section, therein setting limits of rotation of said blade clamp barrel and the attached blade clamp.

* * * * *